United States Patent [19]

DeBarea, Sr.

[11] Patent Number: 4,821,550

[45] Date of Patent: Apr. 18, 1989

[54] ROLL FORMING APPARATUS

[76] Inventor: Frank J. DeBarea, Sr., 7150 S. 135th St., West, Clearwater, Kans. 67026

[21] Appl. No.: 114,196

[22] Filed: Oct. 29, 1987

[51] Int. Cl.[4] ..... B21D 5/08

[52] U.S. Cl. ..... 72/181; 72/234

[58] Field of Search ..... 72/181, 179, 180, 182, 72/176, 234, 248

[56] References Cited

U.S. PATENT DOCUMENTS

| | | | |
|---|---|---|---|
| 460,882 | 10/1891 | Nevegold | 72/248 |
| 751,636 | 2/1904 | Hancox | 72/179 |
| 878,636 | 2/1908 | Kashian | 72/179 |
| 1,233,732 | 7/1917 | Vernon | 72/176 |
| 2,961,901 | 11/1960 | Wheeler | 72/248 |
| 3,785,191 | 1/1974 | Dewey | 72/181 |
| 3,823,592 | 7/1974 | Colbath | 72/181 |
| 4,411,146 | 10/1983 | Sulasaari et al. | 72/181 |
| 4,660,399 | 4/1987 | Suter et al. | 72/181 |

FOREIGN PATENT DOCUMENTS

| | | | |
|---|---|---|---|
| 22569 | 6/1971 | Japan | 72/180 |
| 100826 | 8/1980 | Japan | 72/181 |

*Primary Examiner*—Daniel C. Crane

*Attorney, Agent, or Firm*—Kokjer, Kircher, Bradley, Wharton, Bowman & Johnson

[57] ABSTRACT

A roll forming machine comprising unitary upright members mounted on a support platform for housing a plurality of pairs of upper and lower rollers. Upper rollers are coupled with bearings mounted in vertically adjustable guide blocks to allow adjustment of the spacing between the rollers. A drive chain is coupled with the rollers and its serpentine winding reduces the resulting torsional forces exerted on the machine during forming operations.

4 Claims, 2 Drawing Sheets

ROLL FORMING APPARATUS

BACKGROUND OF THE INVENTION

This invention relates in general to metal working machines and, more particularly, to a roll forming machine.

Roll forming machines are used to form sheet material into variously shaped products and generally offer significant economic advantages over other types of fabrication processes. The material is formed by feeding it between pairs of vertically aligned rollers which progressively impart the desired shape to the material as it is pulled from the input to the output end of the machine by rotation of the rollers.

Because of the large cost of roll forming machines and limited floor space in a shop, it is desirable that each machine be easily adaptable to perform various roll forming processes. The construction of conventional roll forming machines, however, makes it extremely difficult to properly set up and adjust the machines, thus reducing the amount of time that they are available for production. As one example, individual uprights are typically used for housing each pair of upper and lower rollers and exact alignment of each housing along the length of the machine is necesary to prevent binding or slipping of the material being formed. Properly aligning each housing, however, can be an extremely time consuming operation as large numbers of these roller and housing sets are required for most forming operations.

In order to reduce the time involved in changing the tooling on these machines, a group of roller and housing sets are often mounted together on a removable platform or raft. These rafts may then be removed and replaced by a raft with the desired tooling when a different forming operation is to be conducted. While this reduces the time required for changing over the machine, it requires a significant capital investment in duplicate castings and rollers.

Other construction features of conventional machines also add significantly to the cost of the machines. Large torsional forces are exerted on the machine by the forming operations and the various machine components are typically constructed from heavy cast metal to prevent warping or failure of the machine. Components such as the support platform and the upright housings must also be machined to exact tolerances to ensure tht the rollers are properly aligned. This type of construction, while necessary for conventional roll forming machine designs, adds significantly to the cost of such machines.

The use of heavy cast metals in the construction of these machines also adds significantly to their weight. This presents an added problem in that it is often desirable that the machines be relocated within the shop such as in those instances when two or more machines placed end to end would increase the efficiency of a roll forming process. The large weight of these machines, however, makes movement of the machines difficult and they are generally left in a fixed location in the ship. In addition, the ship floor must be reinforced to provide adequate support for the machines.

SUMMARY OF THE INVENTION

It is an object of this invention to provide a roll forming machine which may be fabricated from less expensive matreials than conventional machines so that significant savings in the capital investment for each machine may be realized.

It is also an object of this invention to provide a roll forming machine having structural components formed from sheet metal and having a substantially unitary construction which provides the needed strength and stability to withstand the forces exerted during the roll forming process.

It is another object of this invention to provide a roll forming machine which may be fabricated from lighter weight material than conventional machines so that the machine may be operated as a free standing unit and may be easily repositioned to connect with other units when needed.

It is a further object of this invention to provide a drive mechanism for a roll forming machine which reduces the resulting torsional forces exerted during roll forming operations so that the machine may be constructed from lighter weight components without compromising the structural integrity of the machine.

To accomplish these and other related objects of the invention, a roll forming machine is provided which comprises a support platform, a pair of unitary vertical housing members which are coupled with the support platform and are aligned in spaced apart and substantially parallel relationship, and a plurality of pairs of vertically aligned upper and lower rollers coupled with and extending between the pair of housing members. The rollers are driven by a drive chain or other means which is coupled with the rollers in a serpentine fashion to reduce the torsional forces resulting from the roll forming process. This allows the vertical housing members to be formed from relatively light weight sheet metals instead of the heavy casting employed with conventional machines. The unitary construction also ensures that the rollers may easily be placed in the desired alignment.

BRIEF DESCRIPTION OF THE DRAWINGS

In the accompanying drawings in which like reference numerals are used to indicate like parts in the various views.

DESCRIPTION OF THE PREFERRED EMBODIMENT

Figure 1:
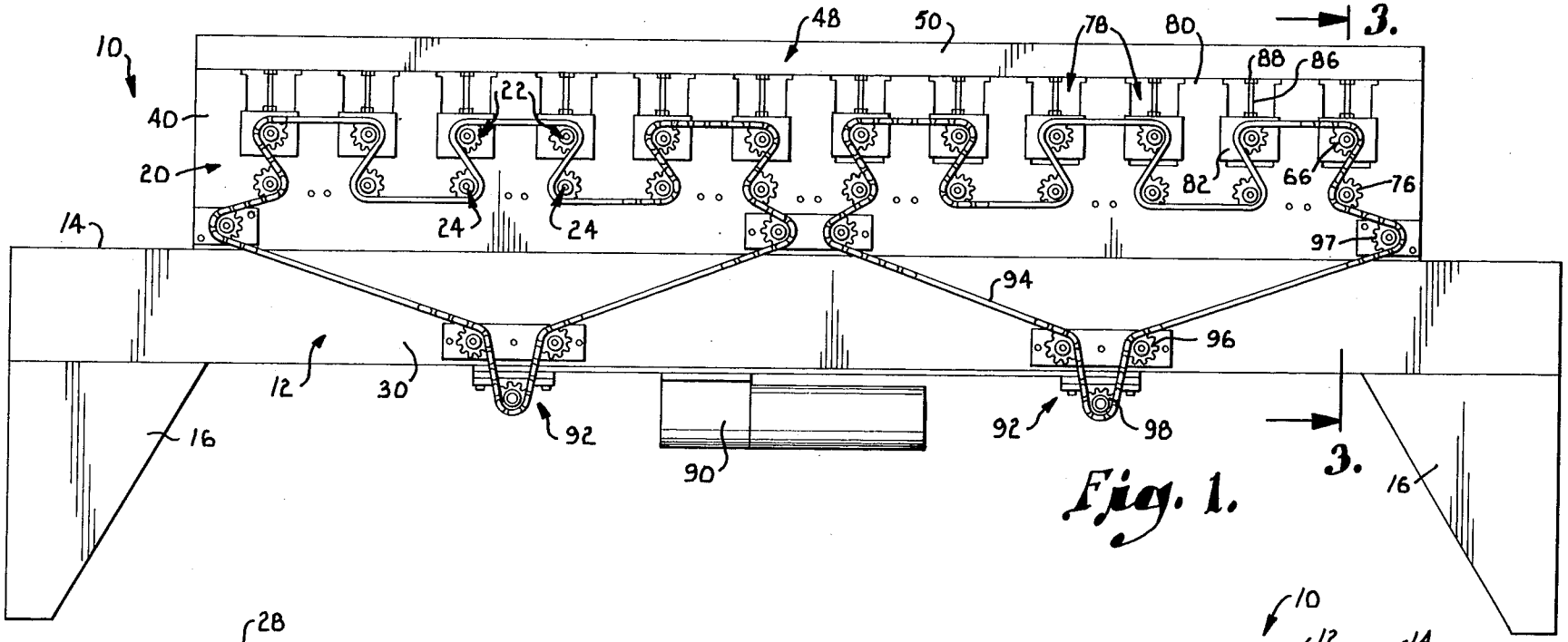
FIG. 1 is a side elevational view of a roll forming machine of the present invention.
Figure 3:
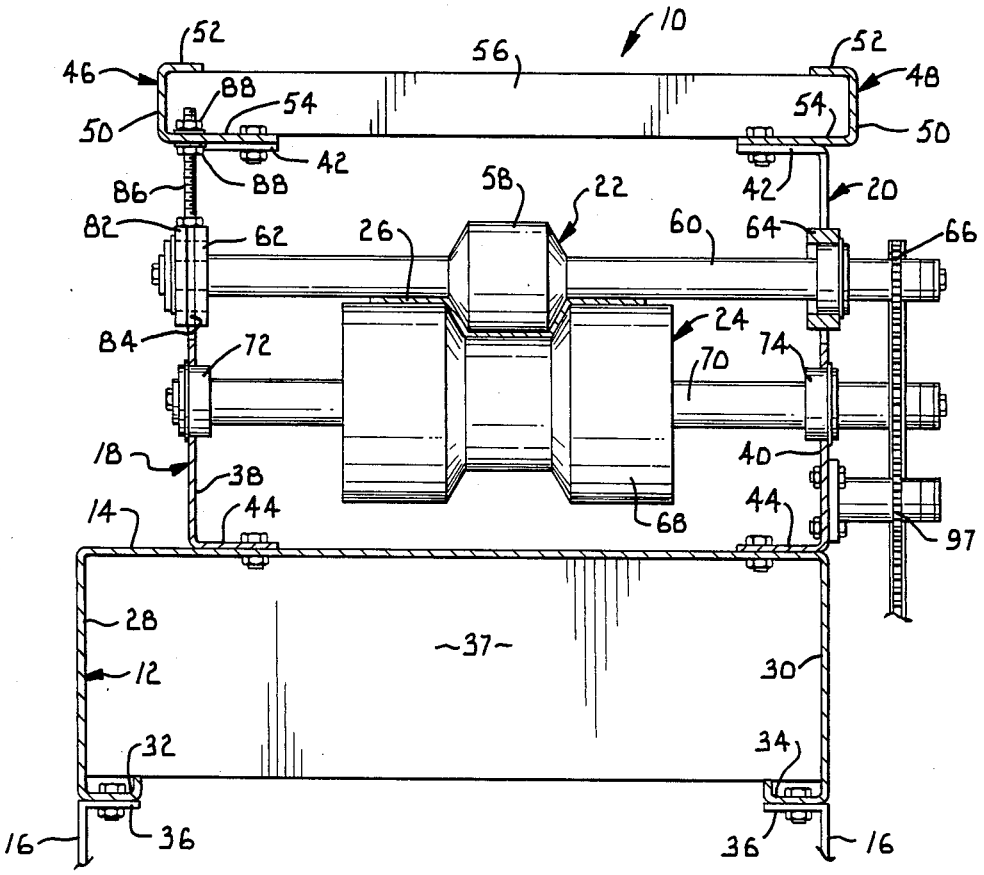
FIG. 3 is a rear elevational view of the machine taken in section along line 3—3 of FIG. 1.

Referring now to the drawings in more detail and initially to FIGS. 1 and 3, a roll forming machine of the present invention is represented generally by the numeral 10. Roll forming machine 10 comprises a support platform or table 12 which includes a substantially flat top surface 14 and leg portions 16. Unitary upright members 18 and 20 are mounted in spaced apart relationship on top surface 14 of the support platform 12 for housing a plurality of pairs of vertically aligned upper and lower rollers 22 and 24 which impart the desired shape to the sheet metal 26.

As best shown in FIG. 3, table 12 comprises top surface 14 and perpendicular side walls 28 and 30 which are joined together to form an inverted U-shape. The bottom ends of the side walls are turned inwardly and upwardly to form flanges 32 and 34 which are bolted to similar flanges 36 on legs 16. Bracing members 37 may be coupled with side walls 28 and 30 to provide added stability to the table. Support table 12 may be fabricated using known techniques from many materials of suitable strength and is preferably formed from steel to provide a light-weight construction which does not require machining to obtain the desired accuracy. Turning additionally to FIG. 1, the length of support table 12 may be varied depending upon the desired application but it is preferably longer than the length of housing members 18 and 20 to provide a surface for mounting accessory items (not shown) at either end of the table.

Although other types of construction may be utilized, it is preferred that each housing member be of a unitary construction along its length to withstand the torsional forces exerted during the forming operations. The shape of housing members 18 and 20 can best be seen with reference to FIG. 3. The housing members have a generally inwardly facing U-shape and are preferably formed from steel to provide the desired accuracy and light-weight construction. The members 18 and 20 comprise side walls 38 and 40 which are turned inwardly at the top and bottom edges to form mounting flanges 42 and 44. The lower flange 44 of housing member 20 is bolted to the top surface 14 of table 12 and is positioned so that side wall 40 is vertically aligned with table side wall 30. Lower flange 44 of housing member 18 is similarly bolted to table 12 but is positioned so that side wall 38 is inwardly offset from table side wall 28.

Adjustment braces 46 and 48 are coupled with the top mounting flanges 42 of the housing members and may also be formed from steel or other suitable material. Each brace comprises a side wall 50 which is turned inwardly at the top and bottom edges to form flanges 52 and 54. The bottom flange 54 is respectively bolted to top flange 42 of housing members 18 and 20 and is wider than top flange 54 to allow side wall 50 to be outwardly offset from the side wall of the housing member.

Rectangularly shaped bracing members 56 extend between adjustment braces 46 and 48 and comprise material such as sheet metal. The bracing members 56 are mounted upright on an edge and are sized to extend into the channel formed by the U-shaped adjustment braces. Members 56 may be coupled with the braces by welding or other suitable methods. A removable cover (not shown) may also be coupled with the adjustment braces to enclose the top of the machine 10.

A plurality of bracing members 57 extend between upright support members 18 and 20 and provide additional structural support to prevent warping or bowing of the support members. Side rollers **57*a*** may also be mounted on the bracing members when needed for particular forming operations. To allow proper positioning of the side rollers, a bracing member is located adjacent each pair of rollers.

Again referring to FIG. 3, the machine tooling will now be described in greater detail. Upper roller 22 comprises a shaped tooling element 58 which is mounted on a shaft 60. Adjacent tooling elements preferably differ in shape so that the desired form is progressively imparted to the sheet material 26 as it moves from the input to the output end of the machine 10. One end portion of the roller shaft 60 is coupled with a bearing 62 which is adjustably mounted on side wall 38 of housing member 18. The other end portion of the roller shaft extends through a bearing 64 adjustably mounted on side wall 40 of housing member 20 and is coupled with a chain drive sprocket 66.

Lower roller 24 includes a tooling element 68 which is complimentally shaped to conform to tooling element 58. Element 68 is mounted on shaft 70 which is coupled with bearings 72 and 74 mounted in sidewalls 38 and 40 of housing members 18 and 20. The end portion of shaft 70 extends through bearing 74 and is coupled with a sprocket 76 (FIG. 1).

Figure 2:
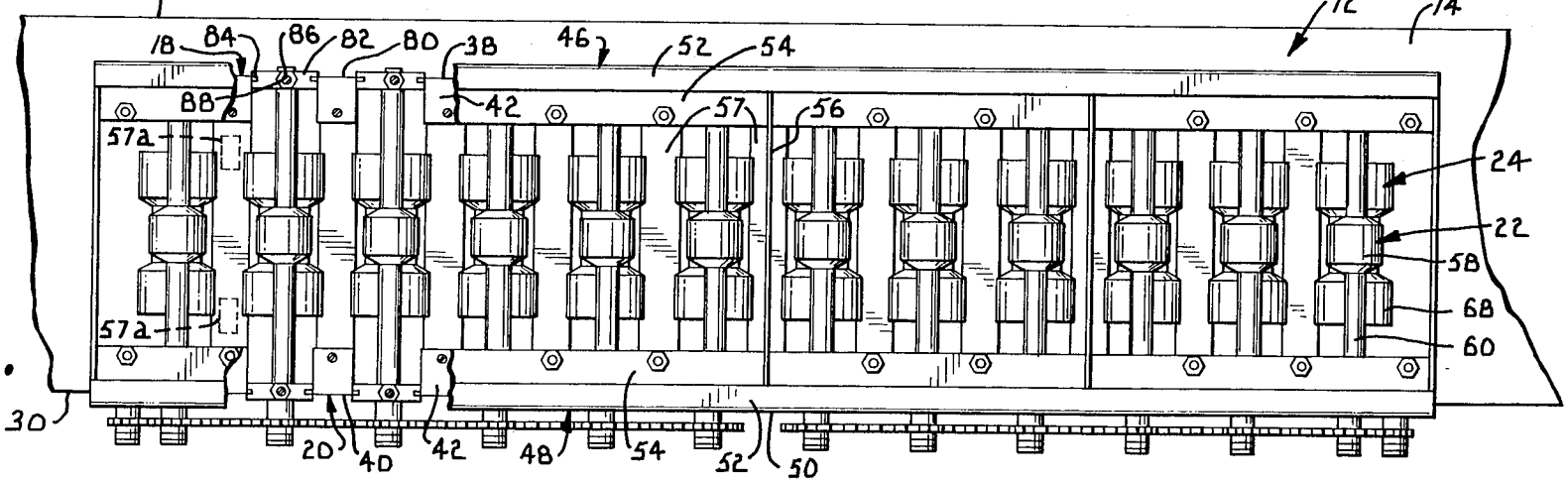
FIG. 2 is a fragmentary top plan view of the machine shown in FIG. 1 with portions broken away to show details of construction.

Turning additionally to FIGS. 1 and 2, the manner in which bearings 62 and 64 are coupled with housing members 18 and 20 to allow vertical adjustment of upper rollers 22 will now be described. A series of slots 78 formed in housing member side walls 38 and 40. Each slot 78 extends downwardly through flange 42 and a portion of the side wall and is separated from an adjacent slot by a tab portion 80. Bearings 62 and 64 are mounted in guide blocks 82 which are vertically adjustable within the slots 78. Blocks 82 are retained within slots 78 by channels 84 which are formed in the vertical edges of the blocks and which are sized to engage the vertical edges of tabs 80.

Vertical adjustment of the guide blocks 82 is provided by bolts 86 which are coupled with a top portion of the guide block and which extend through flanges 42 and 54. Adjusting bolt 86 is preferably centrally positioned along the top edge of each guide block 82. Securing nuts 88 are threaded on bolts 86 and may be tightened against flanges 42 and 54 to fix the guide blocks in the desired position.

Referring more specifically to FIG. 1, the rollers 22 and 24 are driven by a DC motor 90 which is coupled with dual drive mechanisms 92 by suitable gearing. Each drive mechanism 92 comprises a drive chain 94, upper and lower roller sprockets 66 and 76, guide sprockets 96 and 97 and drive sprocket 98. Each drive chain is coupled with a group of sprockets to allow independent operation of each group of rollers.

The drive chain 94 is wound around a series of upper and lower sprockets 66 and 76 in a serpentine fashion so that the upper and lower rollers rotate in opposite directions. The chain directly connects each pair of vertically aligned rollers as it winds around an upper roller sprocket 66 and then extends diagonally to wind around the paired lower roller sprocket 76 in the opposite direction. Alternate pairs of upper rollers and pairs of lower rollers are linked together by the serpentine winding of the chain 95 such that each upper roller is linked with an adjacent upper roller and the paired lower roller is linked in the opposite direction with an adjacent lower roller. A pair of guide sprockets 96 are positioned above and to either side of drive sprocket 98 so that the chain winds further around the drive sprocket to prevent slippage of the chain. A guide sprocket 97 is also offset below the lower roller sprocket at each end of the group of sprockets for the same purpose.

In operation, the adjustable guide blocks 82 allow the spacing between upper and lower rollers 22 and 24 to be easily adjusted by simply turning the securing nuts 88. Once the rollers are in proper alignment, the chain drive mechanism 92 effect rotation of rollers 22 and 24. The sheet of material 26 (FIG. 3) is then fed between the rollers at one end of the machine and is pulled by rotation of the rollers through the machine. As the material moves through the machine, the roller tooling elements 58 and 68 progressively impart the desired form to the sheet material 26.

To prevent binding of the material as it moves through the machine, it is important that the rollers be in parallel axial alignment along the length of the machine. The use of unitary upright members 18 and 20 to house all of the rollers, rather than individual housing members for each pair of rollers as is common with conventional machines, significantly reduces the time required to properly align the rollers. Multiple individual housing members would otherwise have to be individually aligned with a scribe mark along the length of the machine, a procedure which requires a significant amount of time and significantly reduces the flexibility of conventional machines to perform various forming operations.

The chain drive mechanism 92 also reduces the resulting load pressure exerted by the material 21 as it is formed by the rollers and thus allows the machine to be formed from lighter weight components. Each vertically aligned pair of rollers is connected together by chain 94 which resists the vertical spreading force exerted on the rollers by the material 21. Each upper roller and lower roller is similarly linked by chain 94 to an adjacent upper roller and lower roller, respectively, with the chain reducing the resulting horizontal spreading forces exerted on the rollers by the forming operation. This serpentine winding of chain 94 thus greatly reduces the loading forces which are exerted on the structural components of the machine.

The upright members 18 and 20 which house the rollers are also better suited for withstanding the horizontal spreading forces than conventional housing members. The generally one-piece construction of the members distributes the loading forces along the length of the machine so that the members may be fabricated from sheet metal. Conventional machines generally utilize individual members for each pair of upper and lower rollers, thus necessitating the use of heavy cast metal to provide the needed structural integrity. The chain drive mechanism 92 reduces the resulting torsional forces and in combination with the unitary upright members 18 and 20 allows the machine to be fabricated from lighter weight materials while maintaining the required structural integrity.

Distortion or bowing of the machine during forming operations is further reduced by the use of bracing members 56 and 57 and adjustment braces 46 and 48. Members 57 serve the dual function of providing a support platform for side rollers which are required in many forming operations.

The use of formed sheet metal rather than cast metal in the construction of the machine significantly reduces the overall cost and weight of the machine and also allows it to operate as a freestanding unit which may easily be moved and linked with other machines. This not only increases the versatility and efficiency of the machines but also eliminates the need to reinforce the floor as conventional machines typically require.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A roll forming machine comprising:

a unitary platform formed into a generally U-shaped configuration with opposed vertical side walls and a generally flat upper surface extending between upper edges of said side walls, said flat upper surface extending generally horizontally;

a pair of unitary housing members mounted on said platform upper surface in spaced apart and parallel relationship;

a plurality of pairs of vertically aligned upper and lower rollers coupled with and extending between said pair of housing members, each of said rollers comprising a tooling element mounted on a rotatable shaft for progressively bending sheet material fed therethrough;

means coupling said upper rollers with said housing members to allow variable vertical positioning of said upper rollers for adjusting the spacing between each paired upper and lower roller;

a plurality of support braces extending between said unitary housing members thereby providing additional structural support to prevent warping and bowing of said unitary housing members;

at least one side rolling tool mounted on at least one of said support braces;

drive means coupled with said rollers for effecting rotation of said upper rollers in one direction and said lower rollers in the opposite direction;

a separate unitary, elongated adjusting brace extending along a top portion of each housing member, each unitary, elongated brace spanning said plurality of pairs of said vertically aligned upper and lower rollers; and bracing members coupled with and extending between said adjusting braces.

2. The invention as set forth in claim 1, wherein said upper roller positioning means comprises guide blocks adjustably positioned in slots formed in said housing members, said guide blocks including vertical extensions threadably coupled with said adjusting braces.

3. The invention as set forth in claim 1, wherein said drive means couples said rollers in a serpentine arrangement by winding around an upper roller in one direction and then extending diagonally to wind around the paired lower roller in the opposite direction.

4. The invention as set forth in claim 1, wherein said vertical housing members and support platform comprise formed sheet metal.

* * * * *